US005934919A

United States Patent [19]

Cross et al.

[11] Patent Number: 5,934,919

[45] **Date of Patent: *Aug. 10, 1999**

[54] ELECTRICAL PLUG RETAINER AND OUTLET COVER SYSTEM

[75] Inventors: Andrew L. Cross, Mantua; Thomas J. Luby, Akron, both of Ohio

[73] Assignee: The Dzyne Group, Ltd., Akron, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/786,141

[22] Filed: Jan. 21, 1997

Related U.S. Application Data

[63] Continuation-in-part of application No. 08/661,009, Jun. 10, 1996.

[51] Int. Cl.[6] ..... H01R 13/44

[52] U.S. Cl. ..... 439/136; 439/373

[58] Field of Search ..... 439/136–145, 439/373; 174/65, 57; 220/242

[56] References Cited

U.S. PATENT DOCUMENTS

| | | | |
|---|---|---|---|
| 4,457,571 | 7/1984 | Lavine et al. . | |
| 4,652,069 | 3/1987 | Smith . | |
| 4,810,833 | 3/1989 | Meyers | 439/136 |
| 4,840,577 | 6/1989 | Prouty | 439/373 |
| 4,914,265 | 4/1990 | Mongeau | 439/136 |
| 4,952,756 | 8/1990 | Meyers | 439/136 |
| 5,011,427 | 4/1991 | Martin | 439/373 |
| 5,104,335 | 4/1992 | Conley et al. | 439/369 |
| 5,179,044 | 1/1993 | Muromachi et al. | 439/369 |
| 5,211,573 | 5/1993 | Cross | 439/369 |
| 5,217,387 | 6/1993 | Hull et al. | 439/367 |
| 5,240,426 | 8/1993 | Barla | 439/136 |
| 5,249,337 | 10/1993 | Cross et al. | 24/129 R |
| 5,259,782 | 11/1993 | Giffin | 439/367 |
| 5,273,454 | 12/1993 | Shotey | 439/367 |
| 5,306,176 | 4/1994 | Coffey | 439/367 |
| 5,328,384 | 7/1994 | Magnuson | 439/369 |
| 5,334,042 | 8/1994 | Chevalier | 439/369 |
| 5,336,106 | 8/1994 | Osten | 439/369 |
| 5,336,107 | 8/1994 | Sheryll | 439/369 |
| 5,342,212 | 8/1994 | Francis | 439/149 |
| 5,348,495 | 9/1994 | Kasden | 439/371 |
| 5,382,179 | 1/1995 | Noschese | 439/533 |
| 5,393,243 | 2/1995 | Carmo | 439/369 |

*Primary Examiner*—Hien Vu
*Attorney, Agent, or Firm*—Renner, Kenner, Greive, Bobak, Taylor & Weber

[57] ABSTRACT

A system (10) for retaining a plug (11) carried by a cord (12) in a socket (17) of an electrical receptacle (13) includes, in one embodiment, a plate (14) mountable to the receptacle (13). The plate (14) has opposed lugs (19, 20) on each side of the socket (17). The lugs (19, 20) form opposed slots (21, 22) to receive flanges (32, 33) formed on one end of resilient arms (24, 25) of a retainer (15). In one embodiment, a retention device (27) is formed near the other end of the arms (24, 25) to hold the cord (12). A system (50, 80) for covering sockets (17) includes, in one embodiment, a cover plate (52) with deflectable tines (57, 58) received in the opposed slots (21, 22). Shoulders (54, 55) extend from the top of the cover plate to engage a top edge (68) of the lugs (19, 20). Locking head (62) extends from the end of the tines (57, 58) to engage a bottom edge (69) of the lugs (19, 20). In another embodiment, a gap (82) may be provided to separate each lug (19, 20) so that the system (80) may be employed to cover just a single socket (17).

3 Claims, 6 Drawing Sheets

ELECTRICAL PLUG RETAINER AND OUTLET COVER SYSTEM

CROSS-REFERENCE TO RELATED APPLICATION

This is a continuation-in-part application of U.S. application Ser. No. 08/661,009 filed Jun. 10, 1996, and entitled "Electrical Plug Retainer System."

TECHNICAL FIELD

This invention relates to a system which will retain an electrical plug in a socket and cover the sockets when they are not in use. More particularly, this invention relates to such a system which is used with a conventional electrical outlet such that any tension on the cord which carries the plug will not displace the plug from the socket. Additionally, the invention relates to such a system which allows for the unused socket or sockets to be covered with a latchable cover plate.

BACKGROUND ART

It is oftentimes aggravating to the user of an electrical appliance, such as a vacuum cleaner, to have the power thereto be interrupted during use because the plug has either become loosened or dislodged from the outlet due to various tensions being placed on the power cord. Numerous devices have been designed in an attempt to solve this problem, but all are not without problems of their own. For example, some retaining devices are permanently attached to the wall outlet and can, therefore, present an obstacle when not in use. Others require some type of elaborate modification to the outlet or the plug, while still others require the use of several additional components. Usually such components are, in some complex fashion, attached to the outlet and/or the plug.

Another aggravating occurrence for users of electrical appliances that are plugged and unplugged frequently is where the outlets have child safety plugs or the like inserted into the sockets. These safety plugs provide non-conductive plates with prongs extending therefrom that are insertable into the electrical socket. This prevents small children from injuring themselves by inserting inappropriate items into th e socket. These a safety plugs are designed to be difficult to withdraw; as such, they spread apart the socket contacts which after a period of time may result in loose electrical contact between the appliance and the electrical outlet.

The need thus exists for a plug retainer which is inexpensive to manufacture, easy to install, and which does not require extreme modifications to the electrical outlet or plug. A need also exists for an outlet cover which easily covers the outlet or outlets when not in use, is easy to install and which can be used in conjunction with the plug retainer system.

DISCLOSURE OF THE INVENTION

It is thus an object of the present invention to provide a system for retaining an electrical plug in the socket of an electrical outlet.

It is another object of the present invention to provide a retaining system, as above, which is readily attachable to and removable from the plug and the outlet.

It is a further object of the present invention to provide a retaining system, as above, which does not require any elaborate modification to the plug or the outlet.

It is an additional object of the present invention to provide a retaining system, as above, which can be stored out of the way when not in use.

It is yet another object of the present invention to provide a retaining system, as above, which is inexpensive to manufacture and is composed of a minimal number of cooperating parts.

It is still another object of the present invention to provide an outlet covering system which can be used in conjunction with a retaining system, as above, or separately therefrom.

It is yet an additional object of the present invention to provide a covering system, as above, which does not require any elaborate modification to the outlet.

It is still a further object of the present invention to provide a covering system, as above, which is selectively positionable while the retaining system is in use.

These and other objects of the present invention, as well as the advantages thereof over existing prior art forms, which will become apparent from the description to follow, are accomplished by the improvements hereinafter described and claimed.

In general, a system for covering a socket of an electrical receptacle includes a plate which is mountable to the receptacle in such a way that the socket remains exposed. The plate carries opposed lugs which form opposed slots adjacent to the socket. A cover plate has as least one deflectable tine which is received in a respective slot. When inserted, the tine latches onto the respective lug and is held in place.

A retention device may be provided and includes resilient arms at one end and is adapted to hold an electrical cord at its other end. The arms are provided with flanges near one end thereof to be received in the opposed slots.

Preferred exemplary electrical plug retaining systems and outlet covering systems incorporating the concepts of the present invention are shown by way of example in the accompanying drawings without attempting to show all the various forms and modifications in which the invention might be embodied, the invention being measured by the appended claims and not be the details of the specification.

PREFERRED EMBODIMENTS FOR CARRYING OUT THE INVENTION

Figure 1:
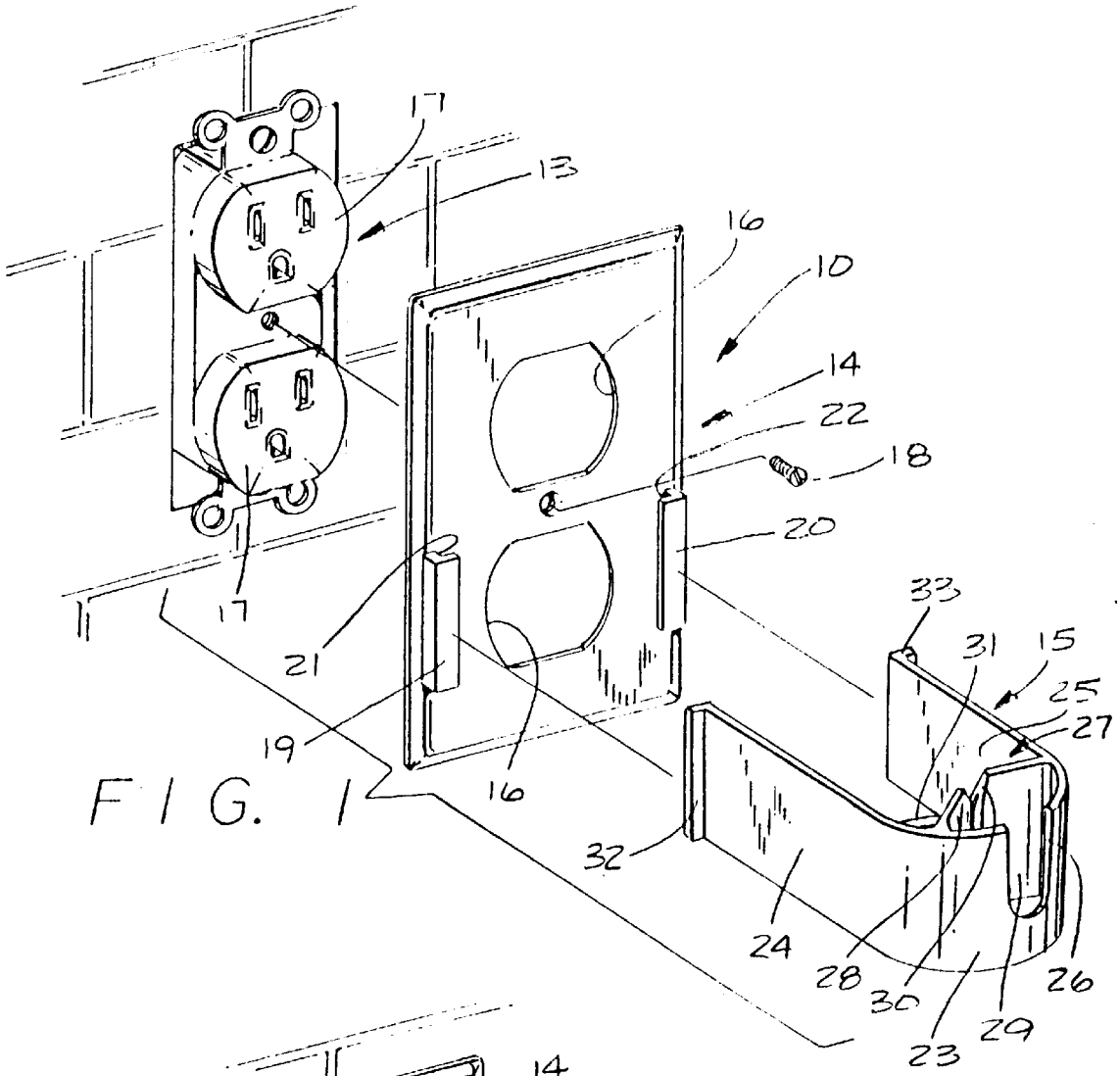
FIG. 1 is an exploded perspective view showing a system for retaining a plug in a receptacle made in accordance with the concepts of the present invention.
Figure 2:
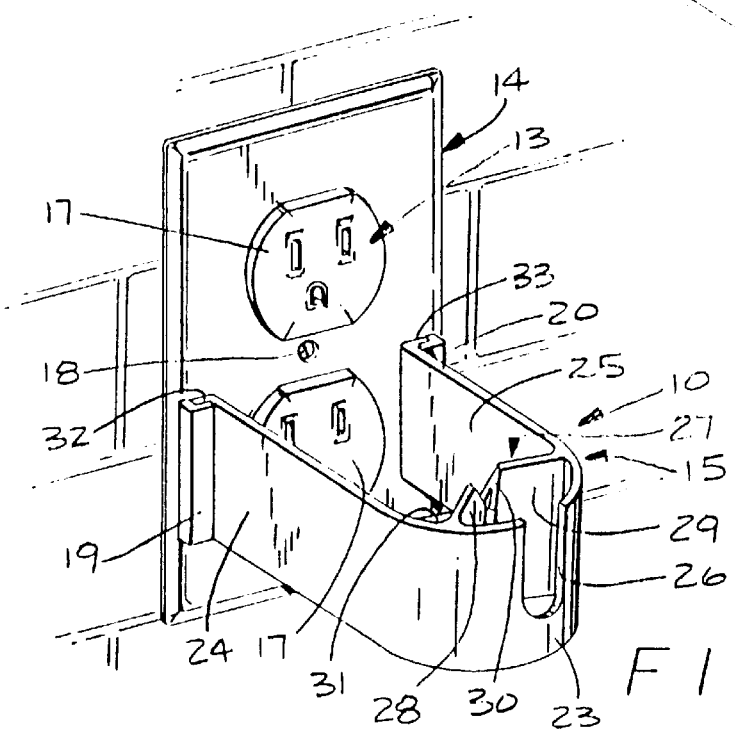
FIG. 2 is a perspective view showing the system of FIG. 1 assembled.
Figure 3:
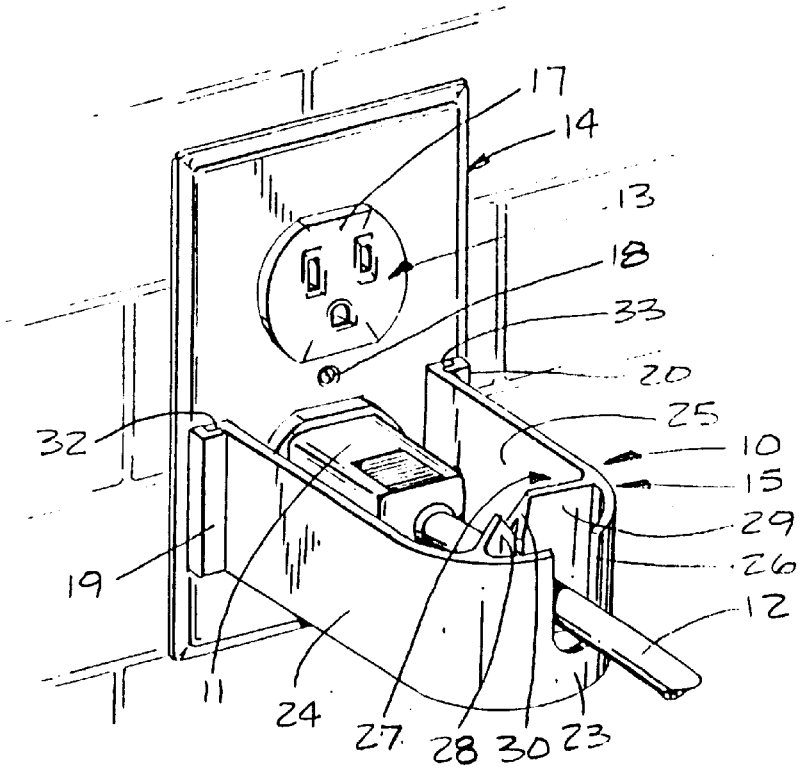
FIG. 3 is a perspective view of the assembled system of FIG. 2 showing a plug in place.

A plug retaining system made in accordance with the present invention is generally indicated by the numeral 10 in the drawings and is adapted to maintain a plug 11, carried by a cord 12, in a conventional wall receptacle generally indicated by the numeral 13. Retaining system 10, as depicted in FIGS. 1–3, includes a modified receptacle face plate, generally indicated by the numeral 14, and a retainer generally indicated by the numeral 15.

Face plate 14 includes the conventional openings 16 which expose sockets 17 of receptacle 13 when plate 14 is attached to receptacle 13, as by a screw 18. Face plate 14 is also provided with at least one set of opposed lugs 19, 20 positioned on each side of and adjacent to a socket 17. While plate 14 is shown as having only one set of lugs 19, 20 positioned adjacent to one of the sockets 17, it is within the scope of the present invention to provide a set of lugs 19, 20 for each socket 17 or to extend the vertical length of lugs 19, 20 so that one set thereof is adjacent to both sockets 17. In any of these configurations, opposed lugs 19, 20 form opposed slots 21, 22, respectively, between lugs 19, 20 and face plate 14.

Figure 4:
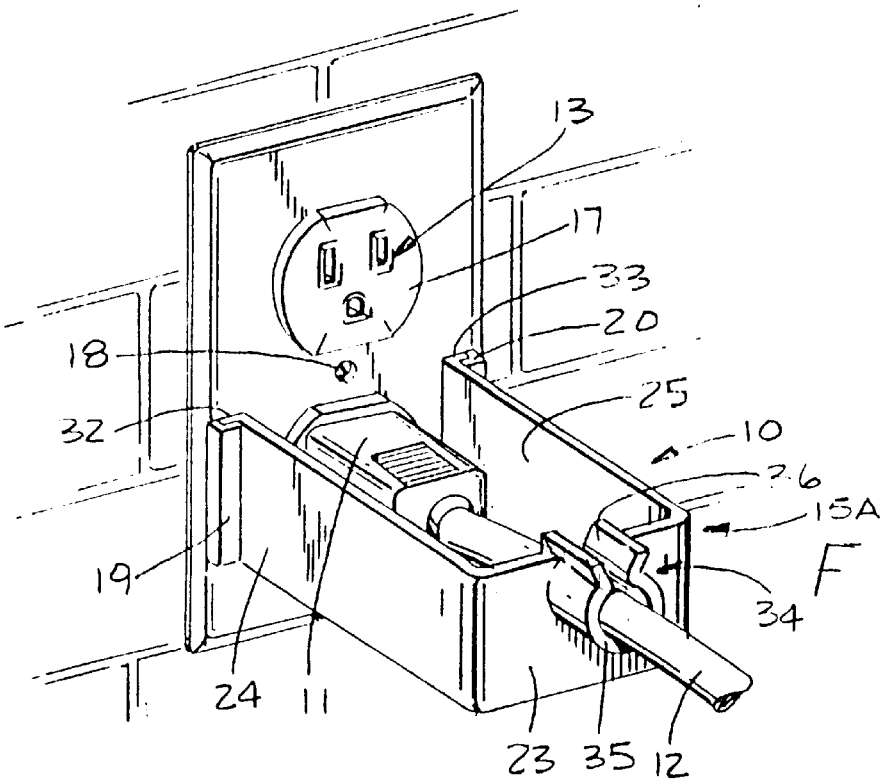
FIG. 4 is a view similar to FIG. 3 showing an alternative embodiment of a retainer of the present invention.

Retainer 15 is preferably formed of an acrylonitrile-butadiene-styrene copolymer (ABS), or equivalent plastic material having good memory characteristics and able to withstand a wide temperature range. Retainer 15 is generally U-shaped in configuration having an outer face 23 at one end thereof and two longitudinally spaced arms 24, 25 extending from face 23. Face 23 can be rounded, or as shown in the embodiment of FIG. 4, can be flat. In the embodiment shown in FIGS. 1–3 and 5, face 23 is provided with a slot 26 therein through which cord 12 of the electrical appliance may freely, slidably pass.

To maintain the connection between plug 11 and socket 17, retainer 15 is provided with a retention device generally indicated by the numeral 27 and positioned near and adjacent to face 23. Retention device 27 can be identical to that shown and described in U.S. Pat. No. 5,211,573 to which reference is made, as necessary, for a more complete understanding of the present invention. Thus, retention device 27 includes opposed flexible filaments or rib-like members 28, 29 extending inwardly from arms 24, 25, respectively, but stopping just short of physically intersecting to form a slot opening 30.

As shown in FIG. 3 when system 10 is assembled with plug 11 and cord 12 therein, cord 12 is clamped between or otherwise engaged in slot opening 30 by members 28 and 29. Thus, the strain caused by any pulling on cord 12 is not allowed to break the connection between plug 11 and socket 17, but rather is absorbed by members 28 and 29.

Figure 5:
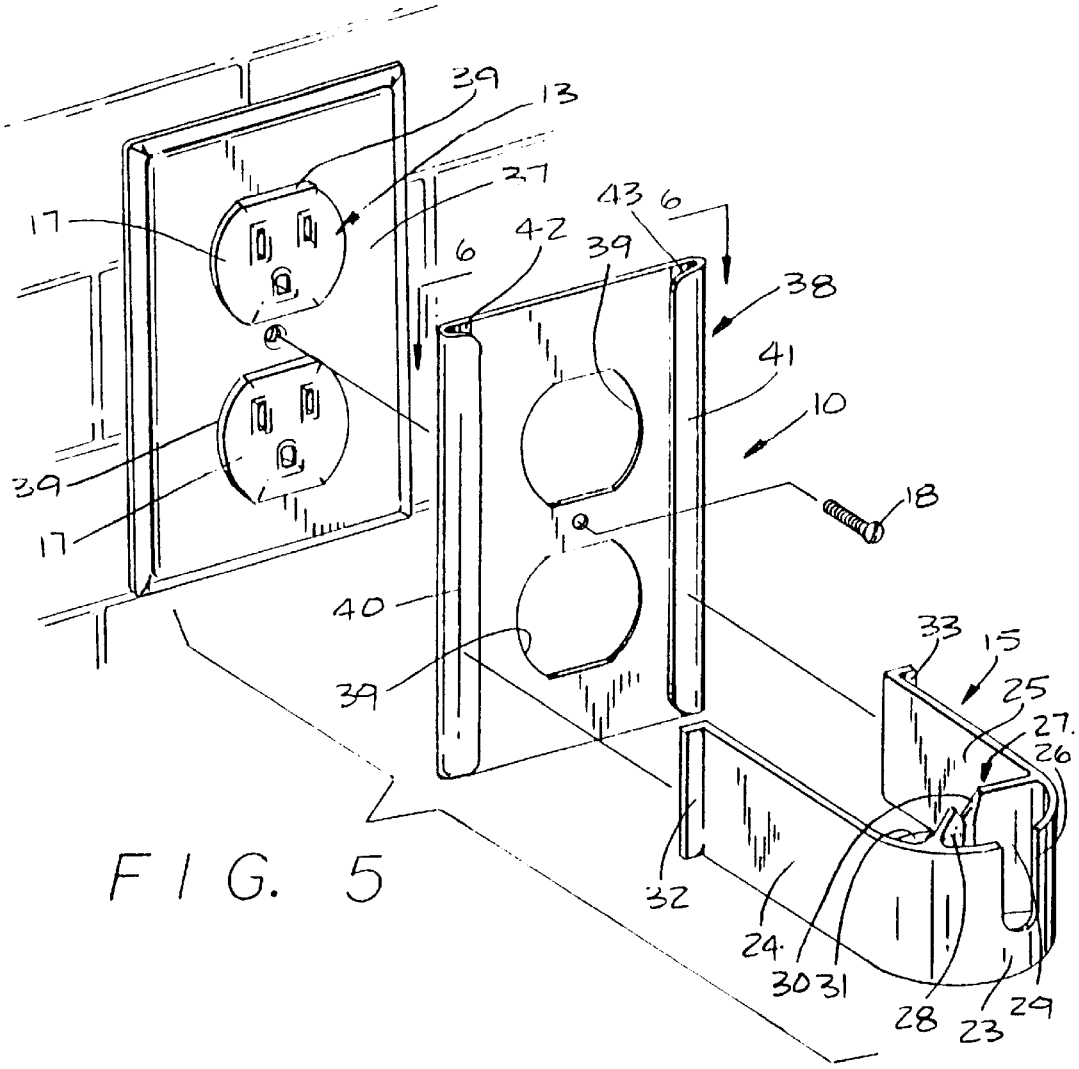
FIG. 5 is one exploded perspective view showing another alternative embodiment of a system for retaining a plug in a receptacle made in accordance with the concepts of the present invention.
Figure 6:
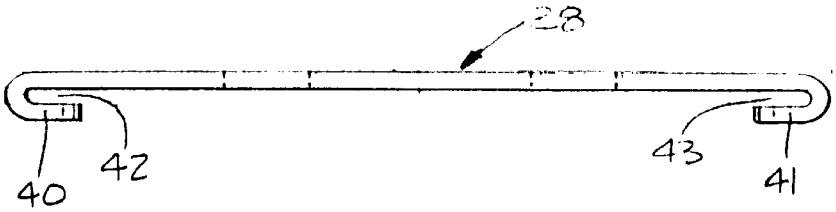
FIG. 6 is a plan view of a portion of the system of FIG. 5 taken substantially along line 6—6 of FIG. 5.

Because of the resilient nature of the plastic material, arms 24, 25 are moveable relative to each other and can be provided with a degree of rigidity at the end near face 23 by ribbing 31, partially shown in FIGS. 1, 2 and 5, and extending between arms 24 and 25. But otherwise, arms 24 and 25 normally have their free ends biased away from each other. Flanges 32 and 33 are formed at these free ends of arms 24 and 25, respectively, and are adapted to be received in slots 21 and 22, respectively, of face plate 14.

Thus, to install retainer 15 in the position shown in FIG. 2, all that need be done is to squeeze arms 24 and 25 slightly toward each other and insert flanges 32, 33 into slots 21, 22, respectively. Releasing arms 24 and 25 permits the outward bias of arms 24 and 25 to maintain retainer 15 on face plate 14. Then, as shown in FIG. 3, plug 11 may be inserted into the socket 17 adjacent to plugs 19 and 20, and cord 12 may be positioned in slot opening 30 to absorb the force of any pulling stress or tension as previously described. When the user is done with the appliance, retainer 15 may be left in position on face plate 14, as desired, or may be readily removed and stored away until a subsequent use.

A slightly modified retainer 15A is shown in FIG. 4. In addition to having a flat face 23, as previously described, the retention device 27 of FIGS. 1–3 is replaced by a keyhole-shaped device generally indicated by the numeral 34. Device 34 includes a generally circular cord receiving area 35 opening into a clip-like cord entrance slot 36. Thus, as shown, cord 12 may be snapped into receiving area 35 by passing it through slot 36 and device 34 can thus be used in the same manner as that device described with respect to FIGS. 1–3.

As shown in FIG. 5, face plate 14 need not be substituted for the conventional household face plate. Rather, receptacle 13 can include a conventional face plate 37 and a specially configured cover plate, generally indicated by the numeral 38, may be provided. Cover plate 38 and face plate 37 may both be attached to receptacle 13 by screw 18 and both are provided with the conventional openings 39 which expose sockets 17.

While cover plate 38 may be provided with the single or double set of opposed lugs, such as lugs 19 and 20 shown in FIGS. 1–4, in this embodiment cover plate 38 is shown as being provided with opposed lugs 40, 41 which extend generally the entire length thereof and thus adjacent to both sockets 17. Lugs 40, 41 form opposed channels 42, 43, respectively, which can receive flanges 32, 33, respectively, of retainer 15. Retainer 15 may thus be placed adjacent to either socket 17 in the same manner as previously described, that is, be squeezing arms 24 and 25 slightly together and inserting flanges 32 and 33 into channels 42 and 43.

An outlet cover system is generally indicated by the numeral 50 in FIGS. 7–10 and is adapted to be used by itself or in conjunction with the plug retaining system 10 and the modified face plate 14 to cover one or both sockets of an electrical receptacle. Outlet cover system 50 includes a slidable cover plate 52 which is received between face plate 14 and opposed lugs 19, 20. Outlet cover system 50 is preferably formed of an acrylonitrile-butadiene-styrene copolymer (ABS), or equivalent plastic material having good memory characteristics and able to withstand a wide temperature range.

Figure 7:
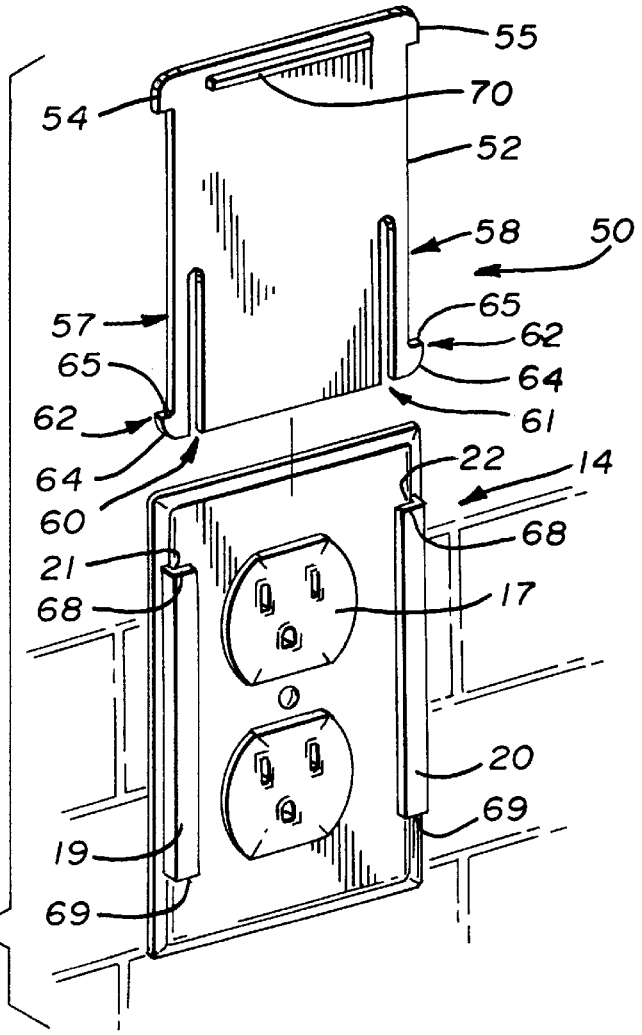
FIG. 7 is an exploded perspective view showing a system for covering an outlet made in accordance with the concepts of the present invention.
Figure 8:
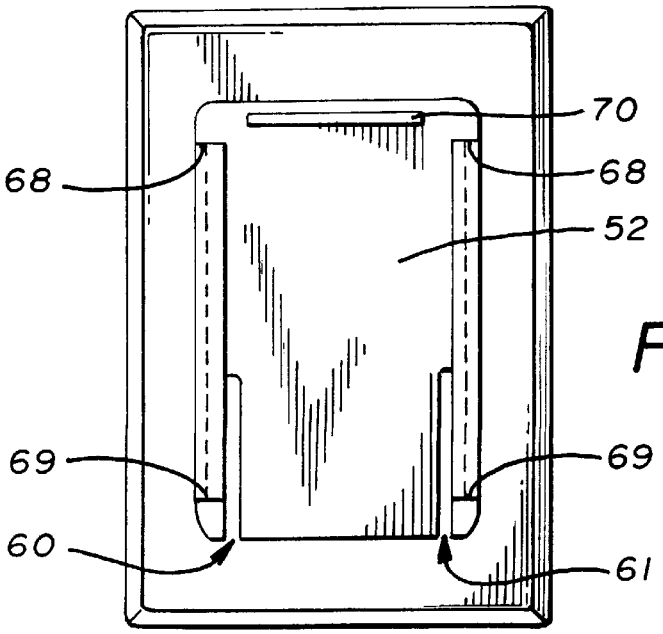
FIG. 8 is an elevational view showing a slidable outlet cover installed over an electrical outlet.
Figure 7A:
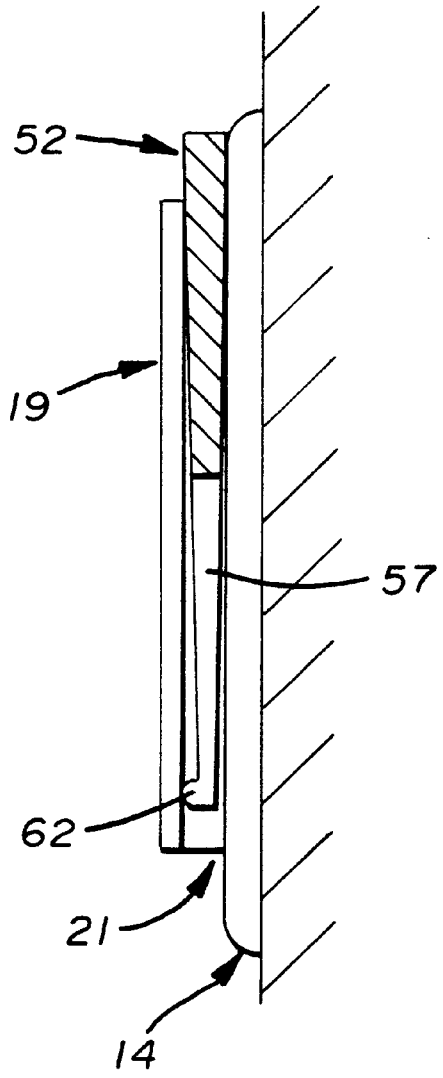
FIG. 7A is a partial cross-sectional view of a deflectable tine received within an opposed lug.
Figure 7B:
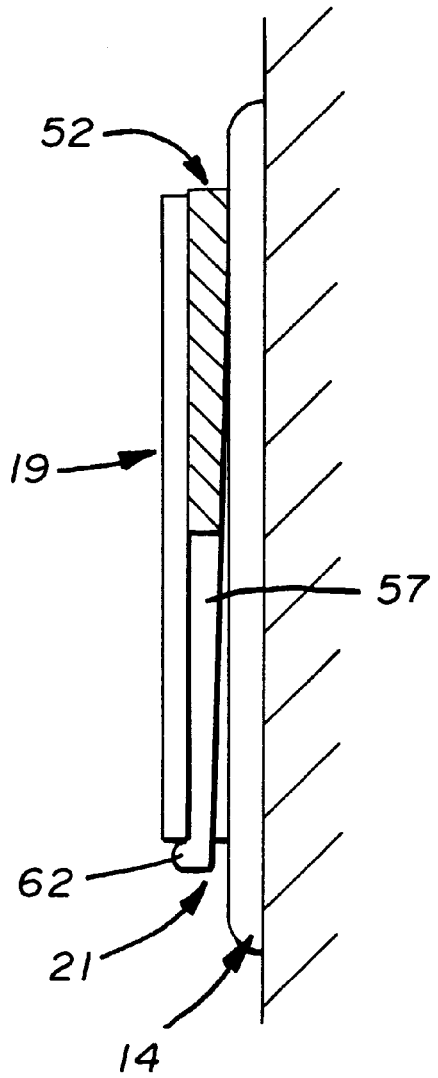
FIG. 7B is a partial cross-sectional view of the tine fully received within the proposed lug.

As seen in FIGS. 7 and 8, the top edge of cover plate 52 provides a set of outwardly extending shoulders 54, 55 which extend to rest upon the top edge of opposed lugs 19, 20. Extending downwardly along the side edges of cover system 50 are inwardly deflectable tines 57, 58. Vertically disposed slits 60, 61 are provided between cover plate 52 and respective tines 57, 58. As such, the tines 57, 58 can only deflect inwardly to the outside edges of cover plate 52. Each deflectable tine 57, 58 is provided with a locking head 62 having an angular insertion surface 64 which strikes opposed lugs 19, 20 and deflects tines 57, 58 inwardly toward cover plate 52 as cover plate 52 is being inserted in slots 20, 21. A latching surface 65 is provided on locking head 62 between angular insertion surface 64 and the outside vertical edge of tines 57, 58. Upon complete insertion of cover plate 52, angular insertion surface 64 no longer contacts opposed lugs 19, 20 and latching surface 65 opposes bottom surfaces of the lugs 19, 20. In a variation of this embodiment, as seen in FIGS. 7A and 7B tines 57, 58 may be deflectable toward face plate 14 with respective locking heads 62 extending toward the user. Of course, other similar deflectable locking head configurations could be employed.

A top edge 68 of each lug 19, 20 abuts outwardly extending shoulders 54, 55 when cover plate 52 is fully inserted. When an upward force is applied to an installed cover plate 52, the latching surface 65 abuts a bottom edge 69 of lugs 19, 20. A grip bar 70 extends transversely from and across cover plate 52 and may extend between shoulders 54, 55. To remove the outlet cover system 50, an individual squeezes deflectable tines 57, 58 inwardly until their respective latching surface 65 is completely within opposed slots 21, 22. In the other embodiment, the individual would press tines 57, 58 toward face plate 14 into slots 21, 22 and withdraw cover plate 52 in the same manner as above. The cover system 50 is withdrawn by pulling up on grip bar 70 until tines 57, 58 no longer contact lugs 19, 20. It will be appreciated that tines 57, 58 exert a sufficient outward engaging force to hold the cover plate 52 at a mid-point position along the vertical length of the lugs 19, 20 so that only one of the two sockets is covered if desired. On the other hand, as shown in FIG. 8, a completely inserted plate 52 will cover both sockets 17. Although it is envisioned that cover system 50 may be inserted from the top horizontal edge of face plate 14, cover system 50 may also be inserted from the bottom horizontal edge, if desired.

Figure 9:
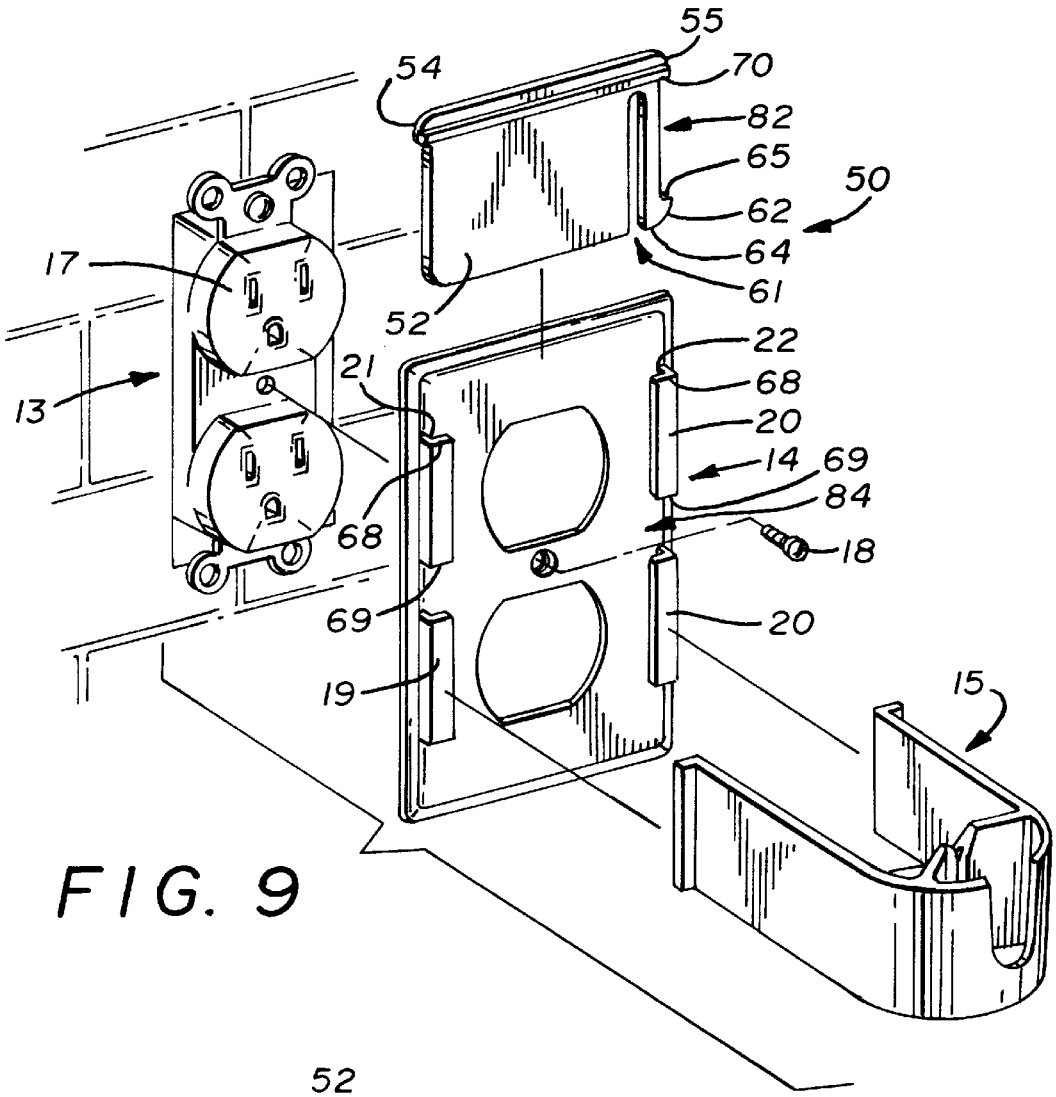
FIG. 9 is an exploded perspective view showing an alternative outlet cover and the manner it may be used with one of the systems for retaining a plug.
Figure 10:
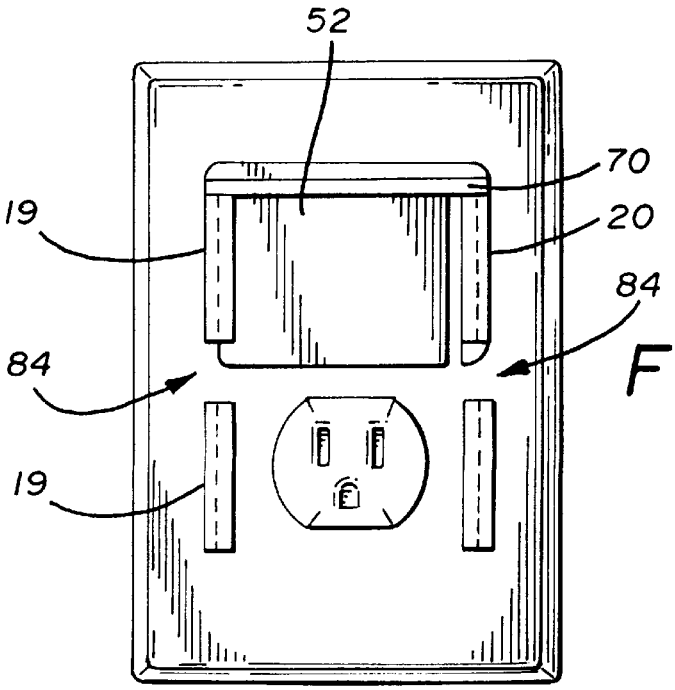
FIG. 10 is an elevational view showing the alternative outlet cover installed over an electrical outlet.

A variation of outlet cover system 50 is shown in FIGS. 9 and 10 which depict a slidable socket cover 80 which covers just one socket 17 of receptacle 13. Cover 80 may be provided with a single, inwardly deflectable tine 82 along a single vertical edge of socket cover 80.

Socket cover 80 is provided with all the other features of cover system 50. In this embodiment, opposed lugs 19, 20 may be provided with a gap 84 along the vertical edges thereof. This allows socket cover 80 to be installed while a retention device 50 is used in the uncovered receptacle in a manner previously described with respect to FIGS. 1–6. Of course, a double tine configuration (tines 57, 58) may also latch into gap 84. In a variation of both embodiments, lugs 19, 20 may be positioned substantially parallel in any orientation with respect to socket 17. This would allow insertion and withdrawal of cover systems 50, 80 from any orientation.

In view of the foregoing, it should be evident that a device constructed in accordance with the concepts of the present invention will maintain a plug in a socket despite pulling forces being applied to the cord which carries the plug and thus accomplishes the objects of the present invention thereby substantially improving the art.

We claim:

1. A system for covering a socket of an electrical receptacle comprising a face plate mountable to the receptacle and exposing the socket, said face plate carrying opposed lugs which form opposed slots that face one another, and a covering device having a cover plate from which extends at least one deflectable tine wherein said cover plate and said at least one tine form a slit therebetween, said at least one tine having a locking head extending in a direction away from said cover plate, said at least one tine and said locking head slidably moveable in at least one of said opposed slots and continuously deflected by at least one of said lugs to bear against said opposed lugs to provide continual self-support over said face plate, said locking head positioned adjacent said lugs when said tine is no longer continuously deflected by said lug and said cover plate completely covers the socket.

2. The system according to claim 1 further comprising a pair of shoulders outwardly extending from an edge of said cover plate, wherein said pair of shoulders are positioned adjacent said lugs when said locking head is positioned adjacent an opposite edge of said lugs.

3. The system according to claim 2 further comprising a grip bar extending from said cover plate in a direction away from said face plate.

* * * * *